US007736013B2

(12) United States Patent
Griffin

(10) Patent No.: US 7,736,013 B2
(45) Date of Patent: Jun. 15, 2010

(54) INTERFACE APPARATUS FOR MOUNTING A PORTABLE ILLUMINATION TOOL & RELATED ILLUMINATION ASSEMBLY

(75) Inventor: Todd Griffin, Miami, FL (US)

(73) Assignee: R/M Equipment, Inc., Miami, FL (US)

( * ) Notice: Subject to any disclaimer, the term of this patent is extended or adjusted under 35 U.S.C. 154(b) by 171 days.

(21) Appl. No.: 11/573,026

(22) PCT Filed: Oct. 31, 2005

(86) PCT No.: PCT/US2005/039079

§ 371 (c)(1),
(2), (4) Date: Dec. 10, 2007

(87) PCT Pub. No.: WO2006/050163

PCT Pub. Date: May 11, 2006

(65) Prior Publication Data

US 2008/0205037 A1 Aug. 28, 2008

Related U.S. Application Data

(60) Provisional application No. 60/623,801, filed on Oct. 29, 2004.

(51) Int. Cl.
*F41G 1/34* (2006.01)

(52) U.S. Cl. ..... 362/110; 362/120; 362/191

(58) Field of Classification Search ..... 362/110, 362/112, 120, 220, 191, 146, 111, 114
See application file for complete search history.

(56) References Cited

U.S. PATENT DOCUMENTS

| | | | | |
|---|---|---|---|---|
| 5,440,465 | A | 8/1995 | Hasness | |
| 5,471,374 | A * | 11/1995 | Palmer | 362/191 |
| 5,540,368 | A | 7/1996 | Oliva | |
| 5,560,703 | A | 10/1996 | Capps, III | |
| 5,685,105 | A | 11/1997 | Teetzel | |
| 5,727,346 | A * | 3/1998 | Lazzarini et al. | 42/146 |
| 5,816,683 | A * | 10/1998 | Christiansen | 362/110 |
| 6,023,875 | A | 2/2000 | Fell et al. | |
| 6,045,239 | A * | 4/2000 | Waldmann | 362/287 |
| 6,116,747 | A * | 9/2000 | Grawemeyer et al. | 362/119 |
| 6,655,069 | B2 | 12/2003 | Kim | |
| 6,712,485 | B2 | 3/2004 | Matthews | |
| 6,994,449 | B2 * | 2/2006 | Kim | 362/190 |
| 2003/0202345 | A1 | 10/2003 | Kim | |
| 2004/0187374 | A2 | 9/2004 | Solinsky et al. | |

* cited by examiner

*Primary Examiner*—Gunyoung T Lee
(74) *Attorney, Agent, or Firm*—Nawrocki, Rooney & Sivertson, P.A.

(57) ABSTRACT

A mounting apparatus (12) for a personal illumination tool (14) having a removable end cap (84) is provided. The apparatus (12) generally includes a sleeve (16) for receipt and retention of the personal illumination tool (14), more particularly, a ring or ring-like member (26) depends from an interior surface of the sleeve (16) for receipt and retention between portions of the illumination tool (14) in furtherance of forming an interference fit therebetween. The sleeve (16) further includes and end portion (18) adapted for affixation to a mount (34). A combination of the apparatus (12) and illumination tool (14) is likewise provided.

26 Claims, 11 Drawing Sheets

INTERFACE APPARATUS FOR MOUNTING A PORTABLE ILLUMINATION TOOL & RELATED ILLUMINATION ASSEMBLY

This is an international application filed under 35 U.S.C. §363 claiming priority under 35 U.S.C. §119(e) (1), of provisional application Ser. No. 60/623,801, having a filing date of Oct. 29, 2004.

TECHNICAL FIELD

The present invention generally relates to illumination devices or tools, more particularly, to an interface apparatus for receipt and retainment of a personal portable illumination tool in furtherance of mounting same to a support structure or mount, as well as illumination assemblies for supported mounting.

BACKGROUND OF THE INVENTION

Very few tasks can be satisfactorily accomplished by people in darkness. For the most part, it is essential to see what we are doing, and our ability to see is proportional to the amount of available light. To supplement insufficient available light, people often use portable illumination tools or devices. Illumination tools or devices, e.g., flashlights, are readily available and virtually universal in application. While styles of these lights vary widely, with specialized structures for select applications, their capabilities are divisible into definable categories that are well known to those within the illumination tools community, see for example the products of SureFire® LLC, California, USA, "2004 Illumination Tools."

Two categories of lights are personal or hand-carried (i.e., hand), and surface-mounted (i.e., surface). Hand lights generally, do not have, as a functional element, the ability to be attached/secured to anything, save for a pocket, vis-a-vis a clip, as exemplified by U.S. Pat. No. 6,547,415 (Matthews), or a belt, vis-a-vis a holster or scabbard, as exemplified by U.S. Pat. No. 5,593,074 (Matthews). Hand lights have elements and features that make them most functional while being held in the hand, either "in carry" or "in use."

Surface lights, typically characterized by a fixture having an integral lamp, are designed to achieve their functionality (i.e., are optimally functional) when attached to a specific object, the functionality being achieved by means of the provision and arrangement of components to accomplish the specific object attachment. For example, in the context of target illumination devices, a lamp is integrally provided as part of a fixture, e.g., a housing or module, for attachment to a weapon, more particularly, to a weapon rail, see e.g., U.S. Pat. No. 5,685,105 (Teetzel) and U.S. Pat. No. 6,609,810 (Kim), the Bright Light Aiming System Tactical (BLAST) 2 from Laser Devices, Inc., California USA, and/or dedicated forend weaponlights from SureFire. Fixtures for target illumination devices also contemplate vertical foregrips equipped with lamp assemblies, see e.g., those of SureFire.

Heretofore known attempts to secure the aforementioned hybrid functionality for an illumination tool appear limited, known devices suffering a variety of limitations, several among them being a lack of versatility, and a lack of, or at least less than desirable, environmental or use integrity (e.g., device/assembly adjustment, repair and maintenance due to a less than desirable interface between the tool and the surface to which it is attached). For example, U.S. Pat. No. 6,712,485 (Matthews), which is a continuation of Matthews '415 previously noted, discloses a bolt/C-clamp combination wherein the clamp is secured about a tube, a head of the bolt being received in an undercut groove intermediate of a flashlight housing; and, U.S. application Pub. No. US2003/0202345 (Kim) which discloses ring forming elements securable about a switch end of a flashlight, one of the ring forming elements including a clamping element (e.g., Weaver style) for attachment to a rail structure of a firearm.

While it is critical that the interface between the personal illumination tool and the fixture within which it is to be received is secure and unwavering, heretofore known assemblies or fixtures have required tools to accomplish securing or integrating the illumination tool to/with the fixture, see e.g., U.S. Pat. No. 5,560,703 (Capps, III) and U.S. Pat. No. 6,023,875 (Fell et al.). While the use of tools for securing the illumination tool with respect to the fixture is less than desirable, the absence of a secures reliable mechanical interface for the illumination tool, see e.g., U.S. Pat. No. 6,851,214 (Oz), is likewise to be avoided as less than advantageous.

In light of the foregoing, there thus remains a need to provide an apparatus and/or assembly which incorporates or combines the aforementioned functionalities, namely, those of the hand and surface lights. Furthermore, and advantageously, such device and/or assembly should provide for a simple, no-tool mechanical interface. Further yet, such apparatus, and assembly incorporating same, should provide for heretofore unseen versatility, more particularly, a modularity such that an illumination tool, directly or indirectly, might be quickly secured to a variety of select surfaces vis-a-vis a variety of mounting means or fixtures, and still further, such device/assembly should confidently retain the tool in all regards so as to, for example, prevent misalignment of same, and associated misdirection of the light beam so generated, or generally undermine the integrity of either the tool, the device/assembly, or the surface supporting same.

SUMMARY OF THE INVENTION

A device, e.g., a fixture, mounting apparatus, or illumination structure, is generally provided for receipt and retainment (i.e., capturing and holding) of an unaltered portable or personal illumination tool, e.g., a flashlight. An illumination assembly is further provided, and generally includes a personal illumination device in combination with the mounting apparatus, e.g., anchoring means, for securing the illumination assembly to a support structure, e.g., a weapon, headgear, vehicle, etc., more generally, a mount. Advantageously, the user needs no tools to couple or integrate the unaltered illumination tool to/with the apparatus of the subject invention in furtherance of forming the assembly of the subject invention. In all its contemplated embodiments, the apparatus of the subject invention needs no preparation, mechanical or otherwise, to receive/retain the unaltered illumination tool.

The subject invention generally comprises a light coupling or interface element adapted to mate with either a variety of support structures (e.g., a rifle, pistol, helmet, etc., more generally fixtures), or other, alternate mounts/coupling devices, or interfaces per se (e.g., magnetic couplings, rotatingly indexed couplings, etc.). In the context of the assembly of the subject invention, such mounting means are traditionally specifically configured to affix a tool or the like to a user select mount such as a weapon using a rail receiving fixture. The assembly of the subject invention vastly expands the functionality of a personal illumination tool by allowing it to be object supported (i.e., selectively and easily object integrated) versus being hand carried. The subject assembly further expands the functionality of the light by allowing it to be object directed/pointed versus being hand directed/pointed.

Further yet, the subject assembly, more particularly the interface element, permits the user to add select surface mounting capability to a light that has not been made with surface mounting capability.

Heretofore, lights made with integral surface mounting capability have been designed to mount to a specific surface contour. The subject assembly "divides" or separates the light holding function from the surface attachment function, i.e., the interface structure of the subject invention imparts a dual functionality for a personal illumination device. Separate parts of the device accomplish each of these functions. Because these functions are separate, a hand light can be attached to a wide variety of surfaces.

The subject assembly advantageously allows the user to attach and detach (i.e., separate/integrate) the light from the assembly quickly, and at-will, without tools or modifications, thereby permitting dual-function, namely, that of a hand-held or surface-held light. Furthermore, the subject assembly is easily user modified (i.e., adapted) for attachment (i.e., reversible securement) to a variety of surfaces by substituting or modifying the mounting means/components thereof. The subject invention, in all its embodiments, is an improvement in form and function from the interface structure disclosed by the present applicant in published international application WO05017439 A2, the underlaying application thereof, i.e., PCT US2003/035601, being incorporated herein by reference.

The resulting versatility of the subject invention greatly enhances utility, functionality, and life-cycle of an illumination tool integrally received by the interface apparatus of the subject assembly, and of the tool and subject assembly, and/or components thereof, individually. More specific features and advantages obtained in view of those features will become apparent with reference to the drawing figures and DETAILED DESCRIPTION OF THE INVENTION.

DETAILED DESCRIPTION OF THE INVENTION & DRAWINGS

Figure 1:
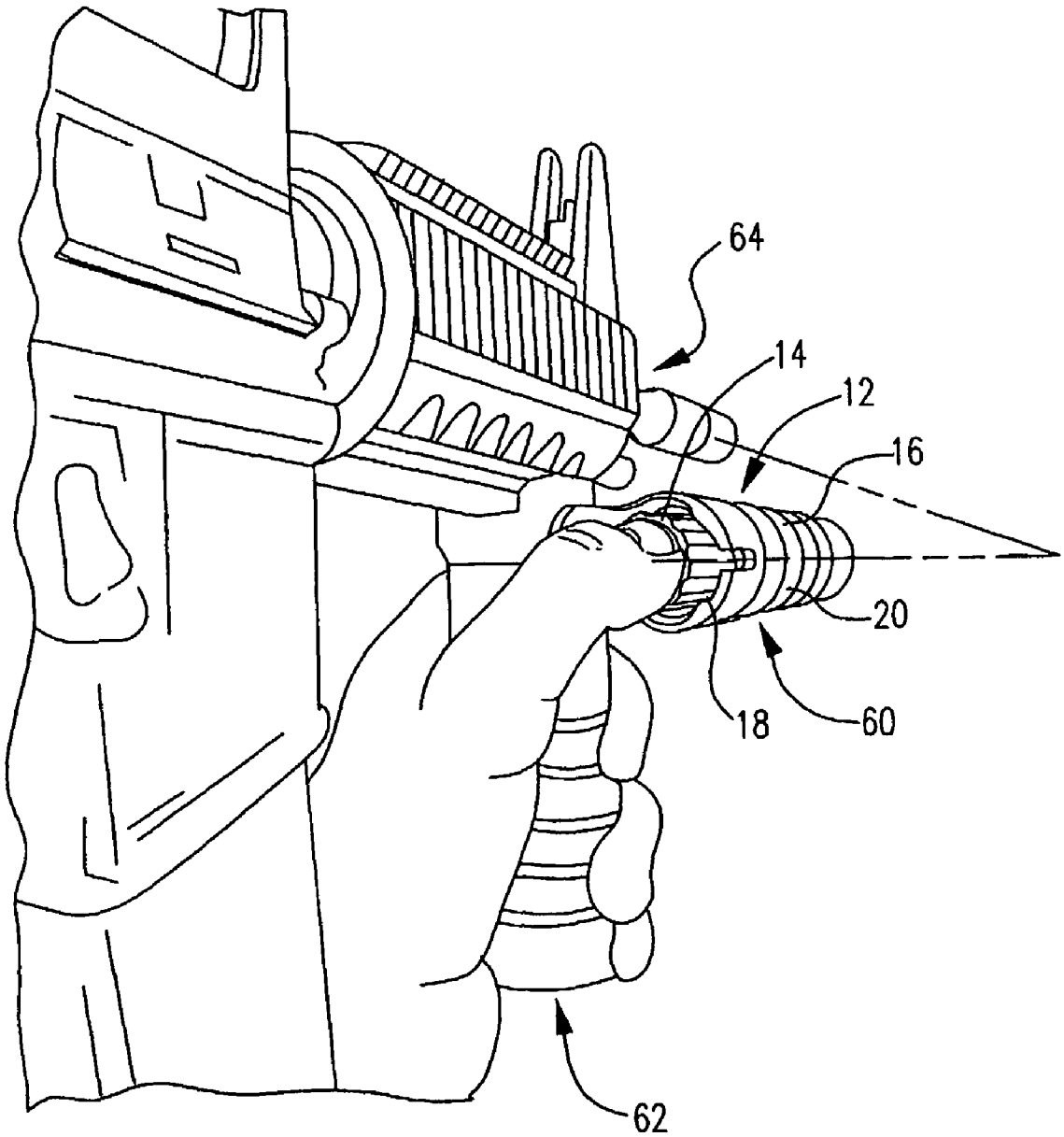
FIG. 1 is a perspective view, from the rear, of an illumination assembly of the subject invention mounted to a rifle, more particularly, a fore end grip thereof.
Figure 4:
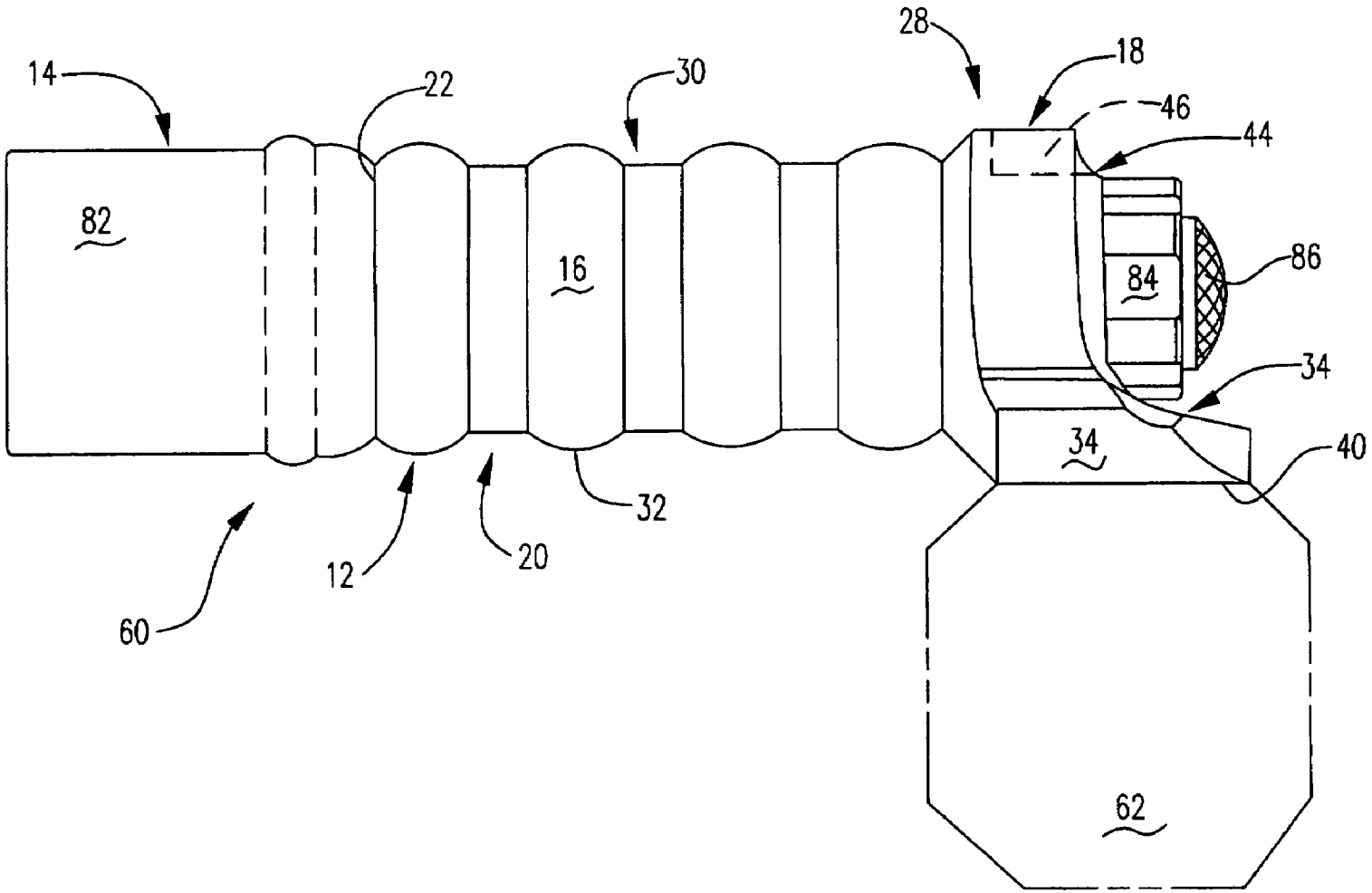
FIG. 4 is a top plan view of the supported assembly of FIG. 1.
Figure 5:
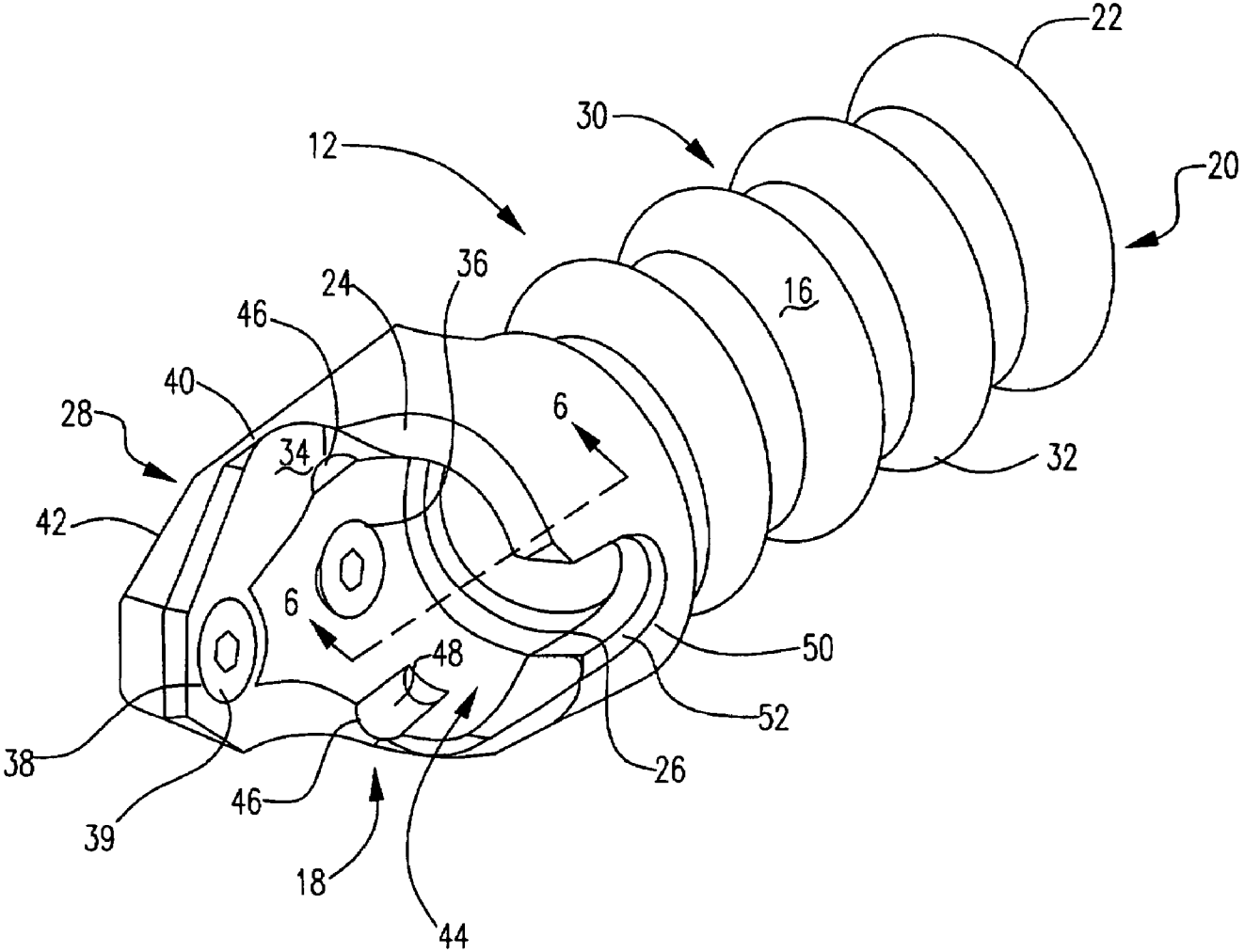
FIG. 5 is a perspective view of an interface or mounting apparatus of the subject invention for receipt and retention of a personal illumination tool.
Figure 7:
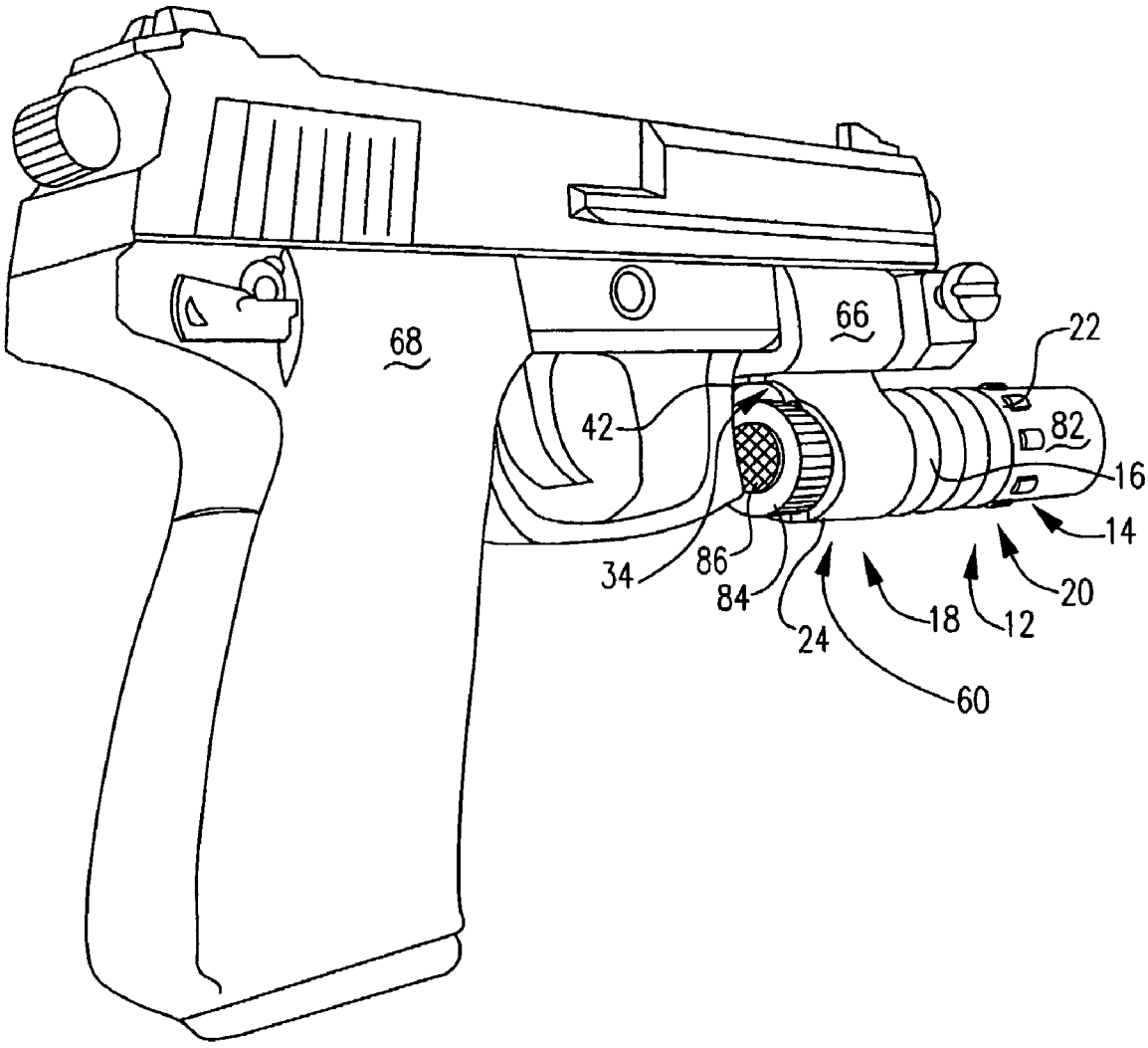
FIG. 7 is a perspective view, from the rear, of a pistol equipped with the illumination assembly of FIG. 4.
Figure 8:
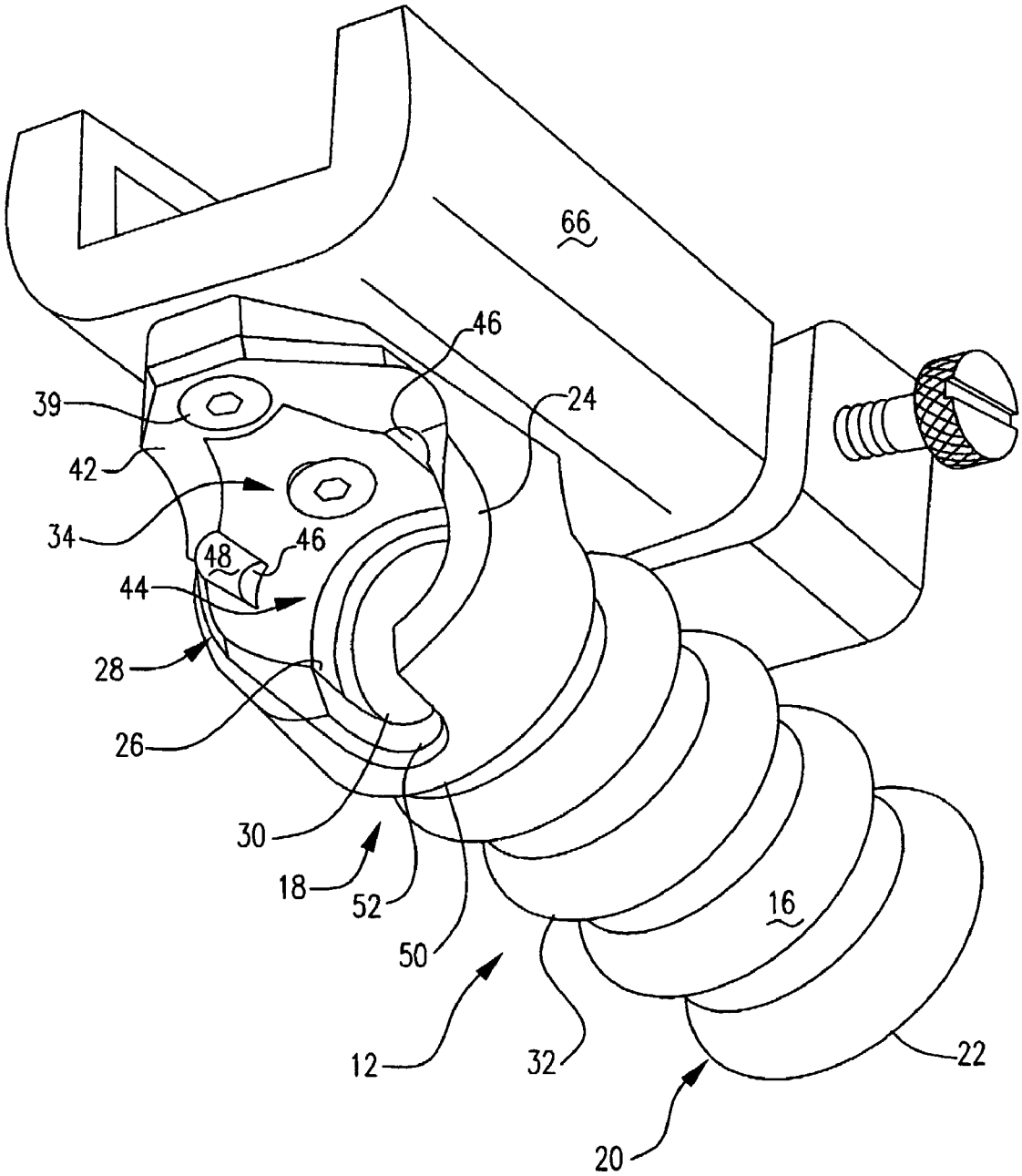
FIG. 8 is a perspective view of the interface apparatus in combination with the rail coupling fixture of FIG. 7.
Figure 9:
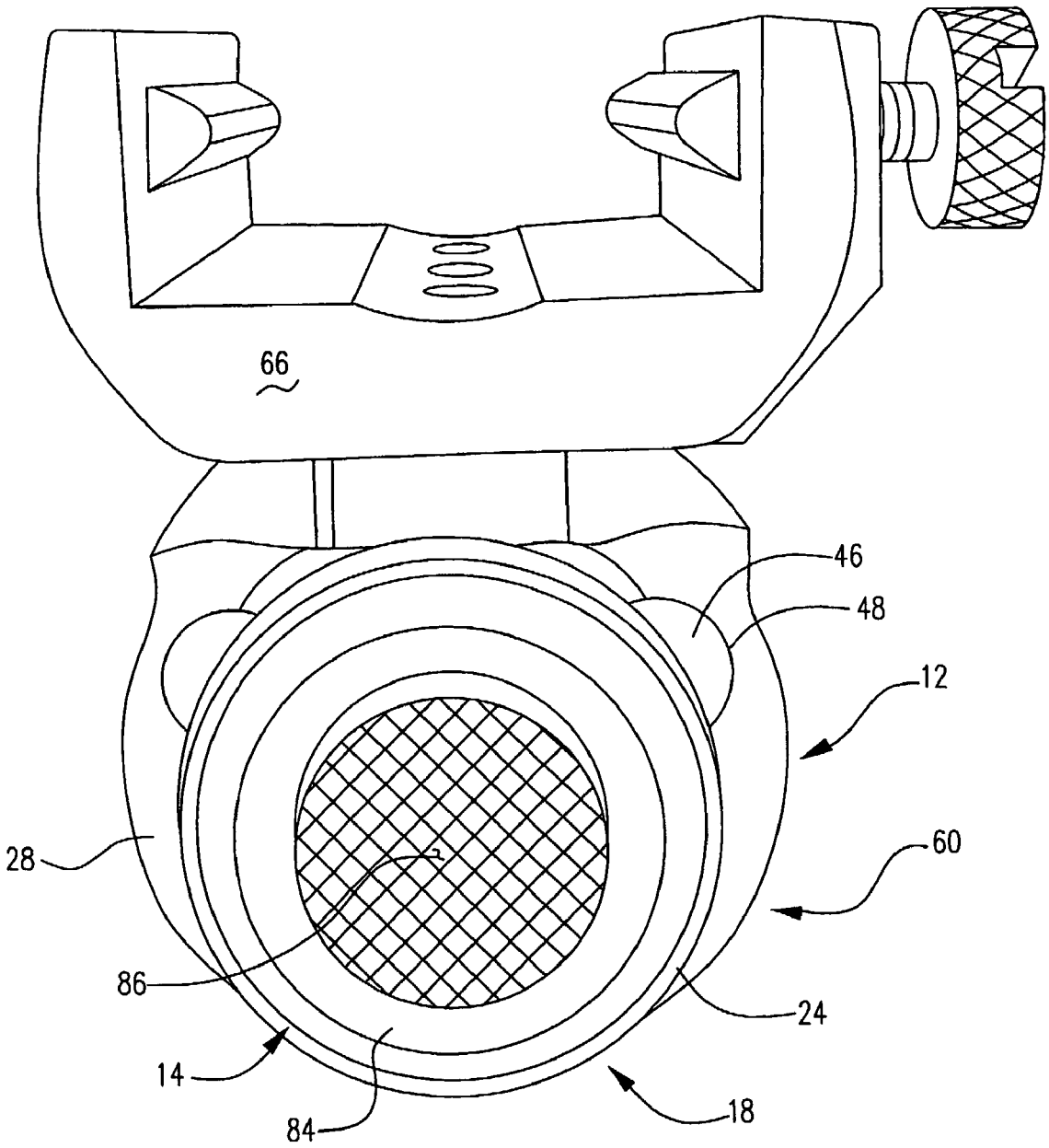
FIG. 9 is a perspective end view of the assembly of FIG. 7, the rail fixture disengaged from the pistol.
Figure 10:
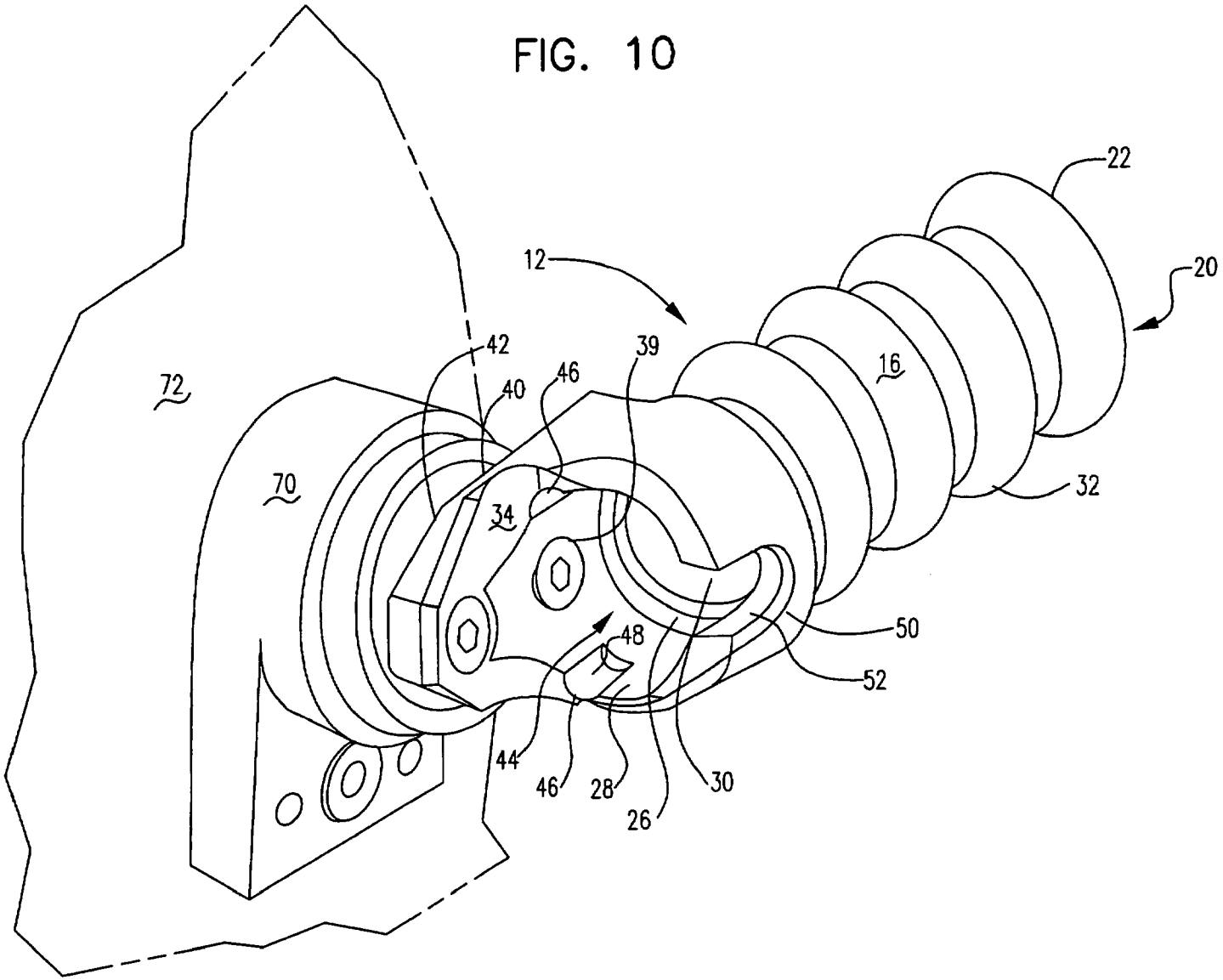
FIG. 10 is a perspective view of the mounting apparatus in combination with a pivotably indexable coupling device suitable for headgear and the like; and, FIG. 11 is a perspective view of the interface apparatus of FIG. 5 in combination with a magnetic coupling device.
Figure 11:
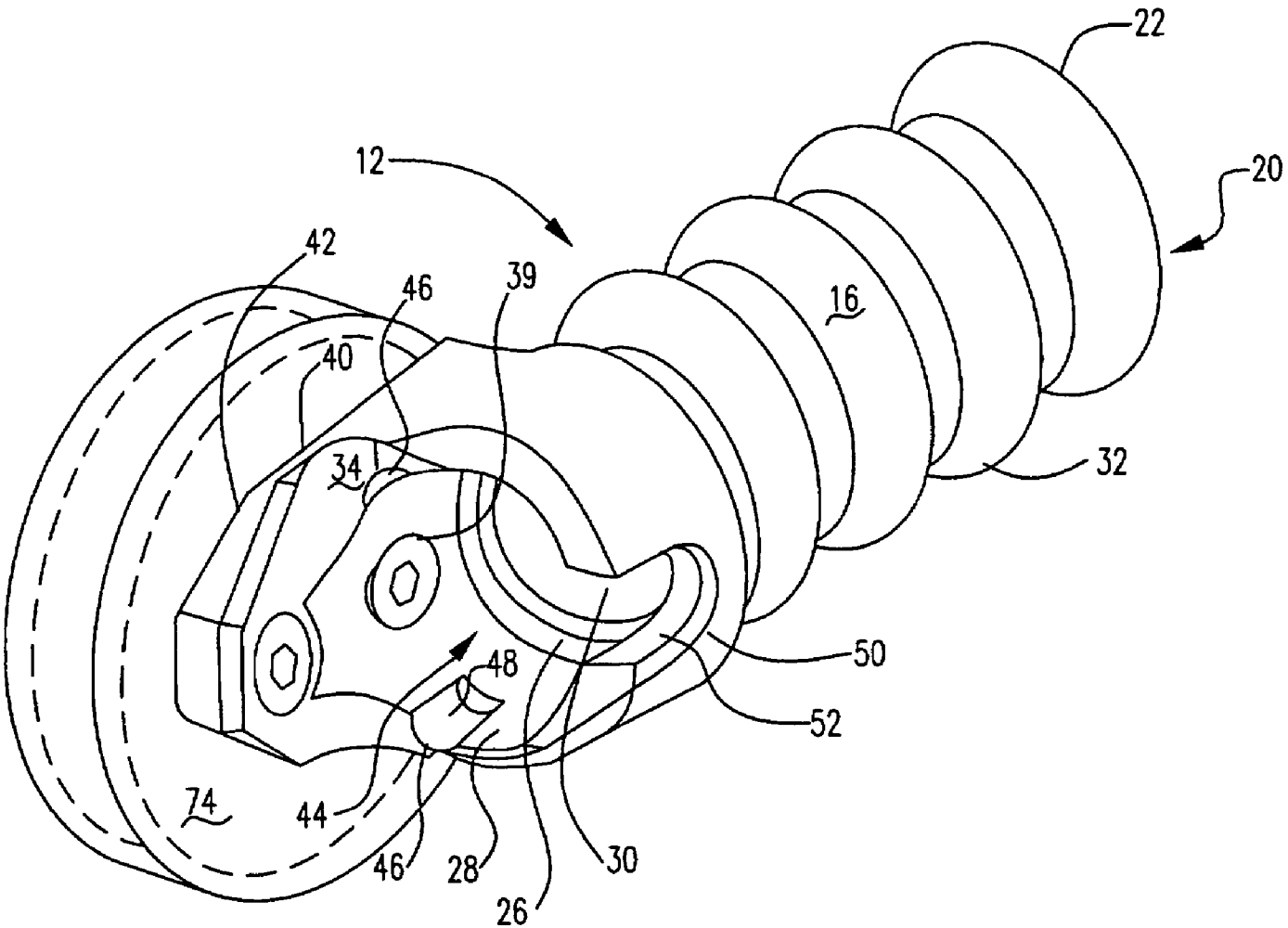

Prior to an initiation of a detailed description of the subject invention, several preliminary remarks are in order. First, in connection with the figures, the interface or mounting apparatus of the subject invention is best shown in FIG. 5, with the illumination assembly of the subject invention best shown in FIG. 2, parts cut away to reveal underlaying detail, as well as in FIG. 4. The interface apparatus of FIG. 5 is shown, in representative, non-limiting environmental contexts, in FIGS. 8, 10 and 11, more particularly, in combination with a variety of known coupling fixtures, e.g., a rail coupling fixture for a firearm (FIG. 8), a pivotably indexable fixture for a hard hat or the like (FIG. 10), and a magnetic fixture (FIG. 11). The assemblies of FIGS. 2/4 are shown in representative, non-limiting environmental contexts in FIGS. 1, 7, and 9, more particularly, directly affixed to, or supported by, a vertical fore end grip of a weapon (FIG. 1), indirectly supported by a pistol via a rail coupling fixture (FIG. 7), and directly mounted to a rail coupling fixture (FIG. 9).

Figure 2:
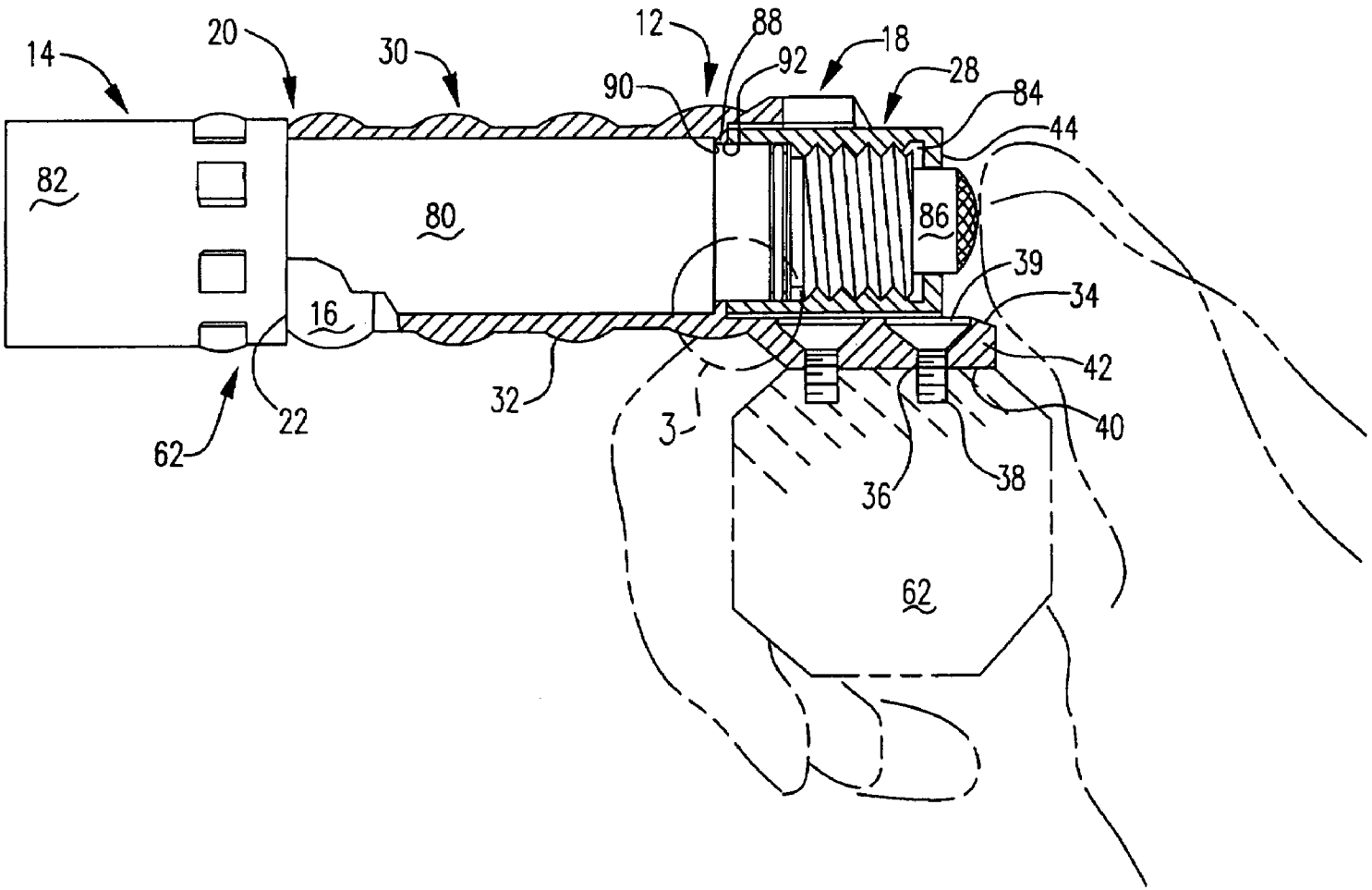
FIG. 2 is a fragmentary top plan view of the assembly of FIG. 1, parts cut away.

Second, as to the nature of the personal portable illumination tool contemplated for receipt and retainment by the interface apparatus, or as a subassembly of the subject illumination assembly, an illustrative, non-limiting unaltered personal portable illumination tool or device is shown in the assembly of FIG. 2, namely a SureFire® G2 personal light, the details of which are generally commercially well-known, and which are generally presented in connection with the disclosure of the aforementioned published U.S. patent application, namely, Pub. No. US2003/0202345 (Kim), incorporated herein by reference. Further representative manufacturers of such tools include, but are not limited to, Longbow Gear Pte Ltd., Stream Light, Inc., and Laser Devices, Inc. As will later be detailed, it is advantageous that the personal illumination tool be capable of integration with the interface apparatus, i.e., a reversible interference fit is formable by a user, without tools, between the illumination tool and the interface or mounting apparatus of the subject invention.

Figure 6:
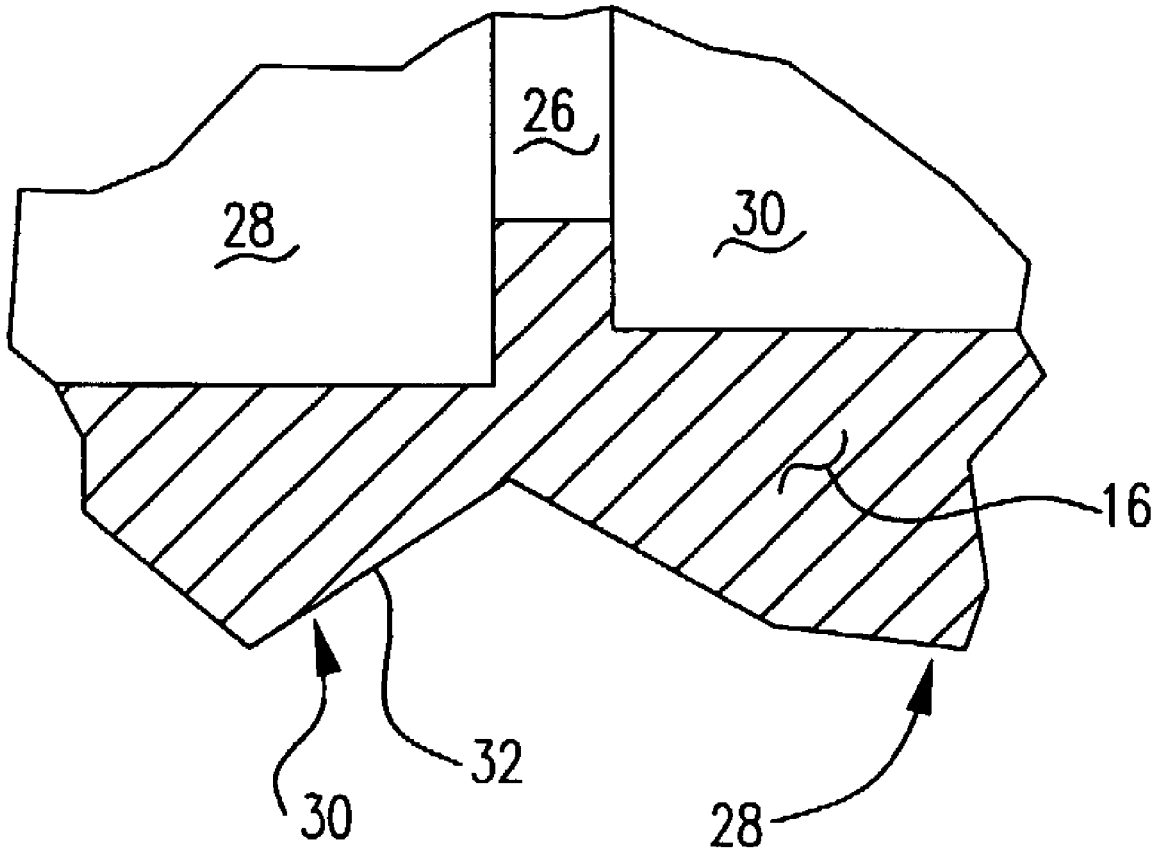
FIG. 6 is an enlarged detailed section taken along line 6-6 in FIG. 5.

With reference now to FIGS. 5 & 6, a mounting apparatus or structure 12 for a personal portable illumination tool is generally shown. The mounting apparatus 12 is generally fashioned as a tubular member, e.g., a sleeve 16, for receipt and retention of the illumination tool. Notionally, the illumination tool is assembleable within the tubular element 16, i.e., the tool may be disintegrated, for instance by removal of an end portion thereof, and reintegrated within the tubular element so as to be integrally formed therewith. Further details are subsequently provided in connection with a discussion of FIGS. 2-4.

The tubular member or sleeve 16 advantageously includes a first end portion 18 advantageously adapted for affixation to a structure support, i.e., a mount, and a second or free end portion 20 opposite the first end portion 18. Each end of the ends of the elongate tubular member 16 general terminate in a rim, the rim 22 of the free end 20 being preferably but not necessarily planar, whereas the rim 24 of the first end portion 18 is advantageously, but not necessarily non-planar, reference FIG. 4, as will be later discussed. As should be appreciated, the notions of first and second are used throughout the subject description to facilitate presentation and discussion of relationships and interrelationships between structures/features of the subject mounting apparatus. Adaptation of the sleeve for affixation to a mount is not exclusively limited to the first end, or second end portion, intermediate adaptation, i.e., at a location along the sleeve intermediate the end portions, is likewise contemplated.

The tubular member or sleeve 16 further includes an internal or interior rim, preferably, but not necessarily as shown in FIG. 5, and detailed in FIG. 6, in the form of an integral ring or ring-like element 26 which generally delimits first 28 and second 30 segments for the sleeve. The interior rim, e.g., a shoulder, flange, radially extending wall, integral ring, etc., advantageously, circumscribes the inner surface of the sleeve 16, although it need not do so.

A critical functional consideration for the subject interface apparatus is the presence of physical structure within a lumen of the sleeve for physical capture or retention between portions or elements of the personal illumination device in furtherance of forming an interference fit between the assembly components, i.e., the illumination device and the interface apparatus. In addition to the integral wall ring depicted, spaced apart wall portions or segments, or a tab, are likewise suitable. The subject functionality is further discussed and developed in connection with the description of the assembly of the subject invention.

Preferably, but not necessarily, the sleeve 16, more particularly, the second sleeve segment 30 thereof, includes a profiled exterior surface 32, as shown in FIGS. 2/3; has a cross section commensurate with that of the illumination tool, i.e., a cross sectional configuration which permits ingress/egress of at least a portion of the illumination tool; and, is advantageously substantially coextensive with the tool body. In furtherance of providing a sheathing functionality, i.e., protection of the illumination tool and maintenance of a secure and stable supported condition, the mounting apparatus is advantageously rigid, preferably, but not necessarily, fabricated from a light weight, high strength material such as aluminum, with the sleeve 16 preferably dimensioned to be substantially coextensive with the illumination tool, e.g., at least the portion thereof rearward of the tool head as shown in FIG. 4. Such arrangement provides supreme protection for the tool of the illumination assembly which ensures proper secure configurational alignment (i.e., the assembly in relation to the mount), thereby greatly minimizing light beam misdirection, as is the case with insubstantial surface area interfaces previously noted, i.e., Matthews '485 and the Kim '345 publication.

The first sleeve segment 28 of the mounting apparatus 12 generally includes a mount platform 34 for receipt upon or at a portion of a support structure, i.e., a mount, having at least a single aperture 36 therethrough for receipt of a fastener or the like 38, and a mount contact surface 40, preferably but not necessarily, a substantially flat mount contact surface. As perhaps best seen in FIGS. 4 & 5, the mount platform 34 may simply be an adapted portion of a sidewall of the first sleeve segment 28. Advantageously, a portion of the mount platform 34, i.e., a tab or ear 42, is adjacent a mouth 44 of the first sleeve segment 28 (see especially FIGS. 4 & 5), the mouth 44 delimited by a portion or portions of the rim 24 of the first member segment 18, i.e., co-planar rim portions thereof. Preferably, as indicated, the first sleeve segment 28, more particularly, the mount platform 34, includes a spaced apart pair of apertures, one of which is located in the tab 42 thereof. Such configuration greatly facilitates access to mounting fasteners 38, and therefore anchoring of the apparatus to the mount.

Further in regard to the first sleeve segment 28, it also advantageously includes at least a single interior surface recess or relief 46, advantageously commencing from the rim 24 thereof, which defines an arcuate surface 48, e.g., see FIGS. 5 and 9. As should be better appreciated in connection with a discussion of the assembly of the subject invention, such relief area permits receipt of a tool or the like between the end cap of the tool and the mounting apparatus (FIG. 9) so as to facilitate reversible union of assembly elements, more particularly, cap "removal" via manipulation, e.g., rotation, of the tool subassembly via the tool head while the cap is held so as to be substantially static.

As previously noted, although the mount platform 34 is preferably integral to an end portion of the sleeve, more particularly first end portion 18 (e.g., see FIG. 1 or 7 wherein such configuration is optimal for illumination tool actuation and minimally intrusive with the support structure), it need not be. Similarly, although the mount platform 34 is preferably adjacent or proximal the integral ring 26 of the sleeve 16 (e.g., FIG. 5), it need not be, i.e., an opposite arrangement is likewise contemplated.

As previously noted, each of the opposing end portions of the sleeve include a rim. The rim 24 of the first sleeve segment 18 advantageously includes a notched portion 50, FIG. 5, a notch 52 thereof substantially registering with aperture 36 of the paired apertures of the mount platform 34. Functionally, the notch 52 facilitates access to a head 39 of the mounting fastener 38, and further permits access to a portion of the illumination tool residing within the first sleeve segment 18. As should be better appreciated in connection with a discussion of the assembly of the subject invention, such access aids in the reversible union of assembly elements. The notch 52, functional much like the aforementioned relief or reliefs 46, permits a casing, tool, device, etc. to "fix" the end cap, in this case relative to the sleeve, in furtherance of disengaging the tool therefrom (i.e., rather than attempt to rotate or spin the end cap in relation to the other tool portion(s), the user, who can readily grip the tool head, can rotate this portion relative to the sleeve/rear cap for disintegration of the elements.)

The rim 22 of the second sleeve portion 20, as shown in FIGS. 2 and 4, is adjacent the head of the illumination tool, more particularly, in abutment therewith, however, such arrangement is not to be considered limiting. By such arrangement, the tool head, or at least a portion thereof, extends forward of the rim 22 for grasping by a user. As previously noted, and as is better appreciated in connection with a discussion of the assembly of the subject invention, such assembly arrangement aids in the reversible union of assembly elements.

With reference now generally to FIGS. 1-4, the device of the subject invention, namely mounting apparatus 12 of FIG. 5, is illustrated in combination with a representative personal illumination tool 14, more particularly, integrally united therewith/thereto, so as to form an illumination assembly 60. Environmentally, the subject assembly or module 60 is shown supported by a weapon grip 62 of a firearm 64, more particularly, the mounting apparatus 12 of the assembly 62 is shown in FIG. 2 affixed to a portion of the weapon grip 62 via threaded fasteners 38 received through the spaced apart apertures 36 of the mount platform 34 thereof. The balance of the discussion likewise applies, unless otherwise noted, to the use environments or assembly applications of FIGS. 7-11, wherein the mounting apparatus 12 of the illumination assembly 62 is affixed to a rail fixture 66 of a pistol 68 (FIGS. 7-9); a pivotably indexable fixture 70 for head gear or the like 72 (FIG. 10); and, a magnetic fixture 74 for support upon a magnetic mount (FIG. 11).

Figure 3:
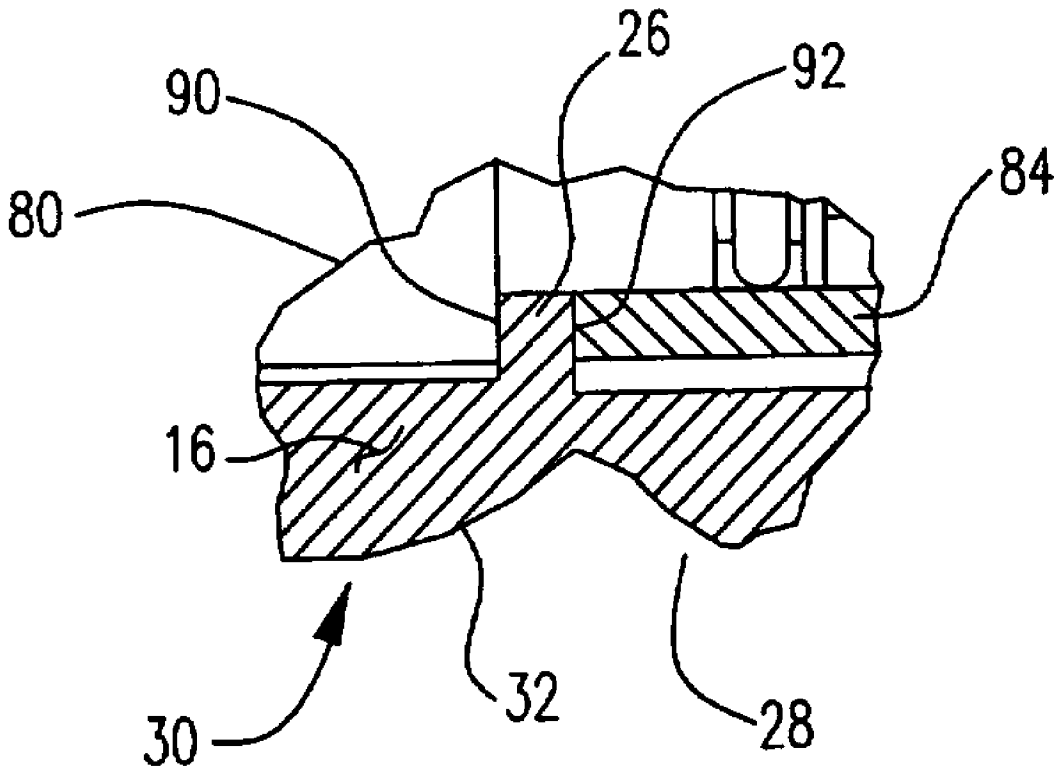
FIG. 3 is an enlarged detail section taken along line 3-3 in FIG. 2.

With particular reference to FIGS. 2-4, an advantageous non-limiting personal illumination tool 14 is shown integral to the subject assembly 62. The illumination tool 14 generally includes a body 80, e.g., battery housing, extending between a head 82, within which is housed a lamp assembly (not shown), and an end cap, more particularly, a removable end cap 84. The end cap 84, within which is housed a switch or switch assembly having an actuator 86, is reversibly received at a free end of the body 80 of the tool 14 to permit access to batteries (not shown) housed therein. As shown, the end cap 84 is threadingly received upon a threaded, reduced diameter end portion of the tool body 80. With proper integration of the end cap 84 with the body 80 of the tool 14, a gap 88 intentionally remains between the end cap 84 and a shoulder 90 of the body 80, the gap 88 generally intended to receive a band of a lanyard system.

As best seen in FIGS. 2 & 3, the integral ring 26 of the sleeve 16 of the mounting apparatus 12 is captured between portions or elements of the illumination tool assembled therein. More particularly, an interference fit is formed between the illumination tool 14 and the mounting apparatus 12 via the imposition of the integral ring 26 between a peripheral edge 92 of the end cap 84 and the shoulder 90 of the tool body 80. A structural element, or series of structural elements depending from an interior wall surface of the sleeve, as discussed in connection with the mounting apparatus, is intended to "fill" the gap or groove of the illumination tool subsequent to receipt of at least a portion of the tool body and reintegration of tool elements, namely, the end cap with the free end of the body.

As to functionality, the mounting apparatus 12 is not generally intended to receive an operative, fully integrated personal illumination tool 14; the removable end cap 84, while generally receivable at either end of the sleeve 16, i.e., either "mouth" thereof, will not pass entirely therethrough due to the structure depending from the interior surface of the sleeve, e.g., the internal surface ring 26 of FIG. 5. Disintegration of the tool 14, as by removal of the end cap 84, permits ingress of a portion of the tool, said ingress limited by interference of the internal surface ring 26 with the shoulder 90 of the tool body 80. Advantageously, the threaded free end of the illumination tool is to be received at the mouth of the second sleeve segment 30 and inserted therein, i.e., from left to right in FIGS. 2 and 4. With such deployment, the tool body substantially resides within one sleeve segment, i.e., the second sleeve segment 30. Thereafter, the end cap 84 of the tool 14 is re-integrated with the tool subassembly via receipt thereof at the mouth of the first sleeve segment 28 and engagement with the threaded free end of the tool body 80. With advancement of the end cap 84 upon the threaded free end of the tool body 80, the tool portions snug into pressing engagement with the internal surface ring 26 of the sleeve 16 so as to abut same, and thereby form an interference fit for elements of the assembly of the subject invention, e.g., FIG. 4. With such arrangement, the end cap 84 of the tool 14 substantially resides within the first sleeve segment 28.

It should be noted, or again noted and emphasized that a variety of personal illumination tool styles are contemplated for integration with the subject device, or deviations thereof. For example, the head 82 of the illumination tool 14, in lieu of or in addition to the rear cap 84 thereof, may be reversibly securable to the tool body 80. Furthermore, a variety of tool switching mechanism/configurations are contemplated (e.g., integral or remote actuators, see e.g., published application WO05017439), the subject mounting apparatus being readily altered to accommodate know styles. For instance, in connection to an illumination tool having an "on body" actuator, a slot or sufficiently elongate cut out (not shown), either forward from the rear rim or rearward of the forward rim, may be provided such that a user may operatively engage the actuator while nonetheless insuring an interference fit, and protection for the retained tool as contemplated.

As should be readily appreciated from the foregoing description, the subject apparatus and assembly adds the functionality of a surface light to a personal portable illumination tool via a simple interface structure. The apparatus receives and retains the tool quickly and easily, typically with no tools required by the user/operator. The apparatus is readily attached to a select surface or mount by a select fixture, as evidenced by the non-limiting examples of FIGS. 9-11. In the outlined approach, the operator quickly and reliably transforms their hand illumination tool into a surface mounted light, and has added new utility to the existing light. The process is easy to reverse, and converts the tool back to its original state or condition, and thus, alternate utility. The operator can optionally change attachment components (e.g., the mount or mount fixture) for the mounting apparatus, allowing heretofore unseen versatility. Having essentially described the genus of the subject assembly, the species thereof depicted in the attendant figures, as well as other know mounts and/or fixtures, are intended to be within the scope of the subject invention.

Be that as it may, there are nonetheless other variations of the subject invention, some of which will become obvious to those skilled in the art. It is to be understood that this disclosure, in many respects, is only illustrative. Changes may be made in details, particularly in matters of shape, size, material, and arrangement of parts, as the case may be, without exceeding the scope of the invention. Accordingly, the scope of the subject invention is as defined in the language of the appended claims.

What is claimed is:

1. A mounting structure for a personal illumination tool having a removable end cap, said mounting structure comprising a unitary tubular member within which the personal illumination tool is received and retained, said unitary tubular member including a first end portion characterized by a mount platform having at least one aperture, and a ring integral and protruding from an interior surface of said unitary tubular member, said integral ring delimiting first and second member segments for said unitary tubular member, and captured between an edge of the end cap and a shoulder of the personal illumination tool received within said unitary tubular member.

2. The mounting structure of claim 1 wherein the personal illumination tool is assembleable within said unitary tubular member.

3. The mounting structure of claim 2 wherein said ring is captured between elements of the personal illumination tool assembled within said unitary tubular member.

4. The mounting structure of claim 2 wherein an interference fit is formed between said mounting structure and the personal illumination tool assembled within said unitary tubular member at said ring.

5. The mounting structure of claim 2 wherein said unitary tubular member includes a profiled exterior surface.

6. The mounting structure of claim 2 wherein said second member segment includes a profiled exterior surface.

7. The mounting structure of claim 2 wherein said unitary tubular member includes a free end opposite said first end portion.

8. The mounting structure of claim 7 wherein a portion of the personal illumination tool extends beyond said free end of said unitary tubular member upon receipt and retention of the tool within said unitary tubular member.

9. The mounting structure of claim 2 wherein said first member segment houses a portion of the removable end cap of the personal illumination tool received and retained by said unitary tubular member.

10. The mounting structure of claim 2 wherein at least a portion of the removable end cap of the personal illumination tool extends beyond said first end portion of said unitary tubular member upon receipt and retention of the tool within said unitary tubular member.

11. The mounting structure of claim 8 wherein a head of the personal illumination tool extends beyond said free end of said unitary tubular member upon receipt and retention of the tool within said unitary tubular member.

12. The mounting structure of claim 8 wherein a lamp assembly of the personal illumination tool extends beyond said free end of said unitary tubular member upon receipt and retention of the tool within said unitary tubular member.

13. The mounting structure of claim 1 wherein said mount platform includes spaced apart apertures for receipt of fasteners.

14. The mounting structure of claim 1 wherein said mount platform includes a mount contact surface.

15. The mounting structure of claim 14 wherein said mount contact surface is substantially flat.

16. The mounting structure of claim 13 wherein said first member segment of said unitary tubular member includes a notched peripheral edge.

17. The mounting structure of claim 16 wherein a notch of said notched peripheral edge registers with an aperture of said at least a single aperture of said mount platform.

18. The mounting structure of claim 1 wherein said unitary tubular member includes a profiled exterior surface.

19. The mounting structure of claim 1 wherein said unitary tubular member comprises aluminum.

20. The mounting structure of claim 1 wherein said unitary tubular member is substantially coextensive with a body of the personal illumination tool.

21. The mounting structure of claim 1 in operative combination with a personal illumination tool.

22. The mounting structure of claim 1 in operative combination with a firearm.

23. The mounting structure of claim 22 wherein said mount platform is received upon a portion of a weapon grip for said firearm.

24. The mounting structure of claim 22 wherein said mount platform is received upon a rail fixture for said firearm.

25. The mounting structure of claim 1 in operative combination with a pivotably indexable coupling device.

26. The mounting structure of claim 1 in operative combination with a magnetic coupling device.

* * * * *